US010160247B2

(12) United States Patent
Beech

(10) Patent No.: US 10,160,247 B2
(45) Date of Patent: Dec. 25, 2018

(54) PLASTIC CARD PRINTING WITH THERMALLY TRANSFERRABLE ADHESIVE

(71) Applicant: Entrust Datacard Corporation, Shakopee, MN (US)

(72) Inventor: Brian Beech, Shakopee, MN (US)

(73) Assignee: ENTRUST DATACARD CORPORATION, Shakopee, MN (US)

( * ) Notice: Subject to any disclaimer, the term of this patent is extended or adjusted under 35 U.S.C. 154(b) by 0 days.

(21) Appl. No.: 15/882,457

(22) Filed: Jan. 29, 2018

(65) Prior Publication Data

US 2018/0215184 A1 Aug. 2, 2018

Related U.S. Application Data

(60) Provisional application No. 62/452,071, filed on Jan. 30, 2017.

(51) Int. Cl.

| | |
|---|---|
| ***B41M 5/26*** | (2006.01) |
| ***B41M 5/382*** | (2006.01) |
| ***B41M 3/14*** | (2006.01) |

(52) U.S. Cl.

CPC ..... *B41M 5/38242* (2013.01); *B41M 3/14* (2013.01); *B41M 5/26* (2013.01)

(58) Field of Classification Search

CPC ..... B41M 5/26; B41J 2/325; B41J 3/60; B41J 2202/35; B41J 2/32; B65C 2009/0003

See application file for complete search history.

(56) References Cited

U.S. PATENT DOCUMENTS

| | | | | |
|---|---|---|---|---|
| 4,825,054 A | | 4/1989 | Rust et al. | |
| 5,037,216 A | * | 8/1991 | Nubson | B41J 2/315 15/100 |
| 5,266,781 A | | 11/1993 | Warwick et al. | |
| 5,326,179 A | * | 7/1994 | Fukai | B41J 3/50 15/100 |

(Continued)

FOREIGN PATENT DOCUMENTS

| | | | | |
|---|---|---|---|---|
| EP | 0579430 A1 | | 1/1994 | |
| JP | 11-235869 | * | 8/1999 | B41M 5/26 |

OTHER PUBLICATIONS

Computer-generated translation of JP 11-235869, published on Aug. 1999.*

(Continued)

*Primary Examiner* — Huan Tran

(74) *Attorney, Agent, or Firm* — Hamre, Schumann, Mueller & Larson, P.C.

(57) ABSTRACT

A plastic card is printed on by transferring an adhesive to a surface of the plastic card from a thermal transfer ribbon using a thermal printhead. A donor material is then applied over the transferred adhesive to adhere the donor material to the card surface with portions of the card surface not containing the transferred adhesive not being covered by the donor material. The techniques described herein permit the addition of high value features, such as three dimensional features, matte finishes, metallic or metallic appearing features, optical structures, and the like, to the surfaces of plastic cards. In addition, the techniques described herein can be integrated into existing card processing systems, such as central issuance card processing systems, that use thermal printing technology.

13 Claims, 3 Drawing Sheets

(56) References Cited

U.S. PATENT DOCUMENTS

| | | | | |
|---|---|---|---|---|
| 5,520,763 | A | | 5/1996 | Johnstone |
| 5,966,160 | A | * | 10/1999 | Nardone ..... B08B 7/0028 347/218 |
| 6,462,765 | B1 | | 10/2002 | Conwell et al. |
| 6,783,067 | B2 | | 8/2004 | Kreuter et al. |
| 6,802,355 | B2 | | 10/2004 | Kline et al. |
| 6,902,107 | B2 | | 6/2005 | Shay et al. |
| 7,398,972 | B2 | | 7/2008 | Schuller et al. |
| 7,434,728 | B2 | | 10/2008 | Paulson et al. |
| 2003/0196747 | A1 | | 10/2003 | Kwasny et al. |
| 2004/0066441 | A1 | | 4/2004 | Jones et al. |

OTHER PUBLICATIONS

International Search Report and Written Opinion issued in PCT/US2018/015850 dated May 23, 2018, 14 pages.

* cited by examiner

PLASTIC CARD PRINTING WITH THERMALLY TRANSFERRABLE ADHESIVE

FIELD

This description relates to performing printing operations on surfaces of plastic or composite cards such as financial (e.g., credit, debit, or the like) cards, driver's licenses, national identification cards, business identification cards, gift cards, and other plastic or composite cards which bear or will bear personalized data unique to the cardholder and/or which bear other card information.

BACKGROUND

It is known to process plastic cards using various techniques including printing, embossing, programming a magnetic stripe and/or an integrated circuit chip, applying holographic foil patches, and the like.

SUMMARY

Apparatus, systems and methods are described where a plastic card is printed on by transferring an adhesive to a surface of the plastic card from a thermal transfer ribbon using a thermal printhead. A donor material is then applied over the transferred adhesive to adhere the donor material to the card surface with portions of the card surface not containing the transferred adhesive not being covered by the donor material. The techniques described herein permit the addition of high value features, such as three dimensional features, matte finishes, metallic or metallic appearing features, optical structures, and the like, to the surfaces of plastic cards. In addition, the techniques described herein can be integrated into existing card processing systems, such as central issuance card processing systems, that use thermal printing technology.

The techniques described herein can be applied to a plastic card such as a financial (e.g., credit, debit, or the like) card, driver's license, national identification card, business identification card, gift card, and other plastic cards which bear personalized data unique to or assigned specifically to the cardholder and/or which bear other card information. The term "plastic card" as used herein is intended to encompass cards that are completely or substantially plastic, as well as cards that have non-plastic or composite components (i.e. a composite card) and cards having other formulations that function like the card types indicated above. Cards that are encompassed by the term "plastic cards" often bear printed personalized data unique to or assigned specifically to the cardholder, such as the name of the cardholder, an account number, an image of the face of the cardholder, and other data.

The terms "printing" or "printed", for example as in "a plastic card is printed on", as used in this description and claims, unless otherwise indicated, refer to a process performed on a surface of the card where an adhesive and/or a donor material (also referred to herein as a transferrable layer) are transferred to the surface of the card using a process that uses pressure and/or heat during the transfer. In this aspect the techniques described herein are similar to a thermal dye printing process and so the techniques described herein may be referred to as "printing" or the like. The printing techniques described herein can be used to apply any type of data to the surface of the plastic card including, but not limited to, alphanumeric text, characters, symbols, designs, graphics, and the like. The printing techniques described herein can be in addition to, or separate from, printing that is applied to the card surface using dye or ink printing using a second thermal printhead.

In one embodiment, a plastic card printing method includes transferring an adhesive to a surface of the plastic card from a first thermal transfer ribbon bearing the adhesive using a first thermal printhead. Thereafter, the surface of the plastic card bearing the transferred adhesive and a donor foil are brought together, with the donor foil including a transferrable layer that faces the surface of the plastic card so that portions of the transferrable layer at locations that correspond to the location of the transferred adhesive are adhered to the transferred adhesive. Thereafter, the donor foil is stripped from the surface of the plastic card whereby portions of the transferrable layer in contact with the transferred adhesive remain on the card adhered to the transferred adhesive and portions of the transferrable layer not in contact with the transferred adhesive remain on the donor foil.

The surface of the plastic card and the donor foil can be brought together in any suitable manner. For example, in one embodiment, the surface of the plastic card and the donor foil can be brought together using a heated roller, particularly by directing the card and the donor foil into a nip that is formed between the heated roller and a backing platen such as a backing roller. In another embodiment, the surface of the plastic card and the donor foil are brought together in a transfer station having a second thermal printhead, where the second thermal printhead is heated at locations corresponding to the locations of the transferred adhesive as the surface of the plastic card and the donor foil are brought together. When the donor foil is stripped from the surface of the plastic card, only the portions of the transferrable layer in contact with the transferred adhesive remain adhered to the plastic card and the portions of the transferrable layer that are not in contact with the transferred adhesive remain on the donor foil.

DRAWINGS

DETAILED DESCRIPTION

Figure 1:
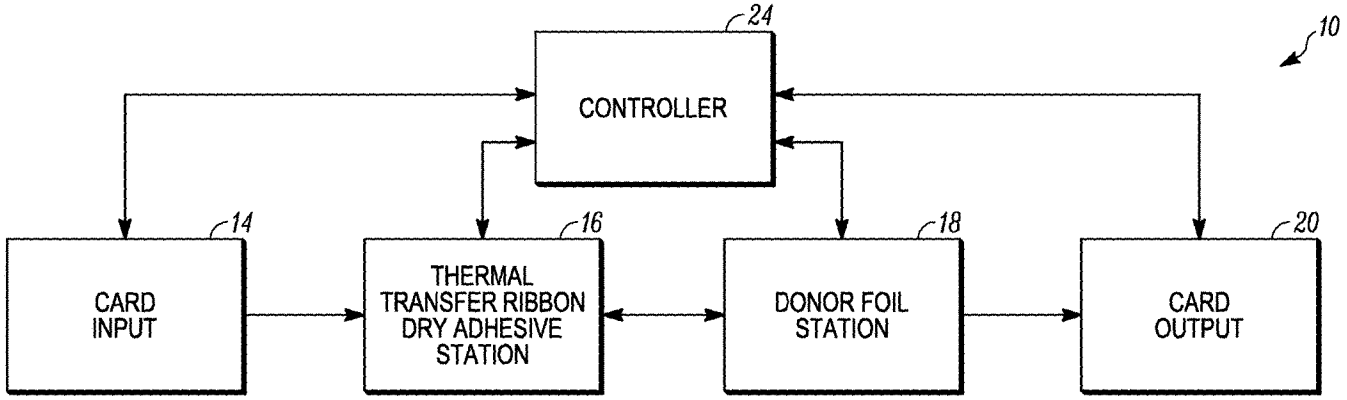
FIG. 1 is a schematic illustration of one embodiment of a plastic card printing system described herein.

As described in further detail below, an adhesive is thermally transferred to a surface of a plastic card from a thermal transfer ribbon using a thermal printhead. A donor material (also referred to herein as a transferrable layer) is then applied over the transferred adhesive to adhere the donor material to the card surface with portions of the card surface not containing the transferred adhesive not being covered by the donor material. The donor material that is adhered to the card surface can form a high value feature on the card surface such as a three dimensional feature, a matte finish, a metallic or metallic appearing feature, an optical structure, and the like.

The term "plastic card" as used herein is intended to encompass cards that are completely or substantially plastic, as well as cards that have non-plastic or composite components (composite cards) and cards having other formulations that function like the card types indicated above. Cards that are encompassed by the term "plastic cards" often bear printed personalized data unique to or assigned specifically to the cardholder, such as the name of the cardholder, an account number, an image of the face of the cardholder, and other data.

The techniques described herein can be applied to all types of plastic cards such as financial (e.g., credit, debit, or the like) cards, driver's licenses, national identification cards, business identification cards, gift cards, and other plastic cards which bear personalized data unique to or assigned specifically to the cardholder and/or which bear other card information. In one non-limiting example, the techniques described herein can be used on plastic financial cards. A financial card, which may also be referred to as a credit card or a debit card, as used herein refers to a type of card that allows the cardholder to borrow funds or that has a stored monetary value. A financial card typically has at least a cardholder name and an account number provided thereon, often by printing. A financial card may also have an integrated circuit chip that stores data relating to the card and/or a magnetic stripe that stores data relating to the card.

The techniques described herein can be implemented in any suitable plastic card printing system. In one embodiment, the plastic card printing system as a whole, and the techniques described herein, have a card throughput of at least about 1500 cards per hour.

One example of a type of plastic card printing system that can be used is referred to as a central issuance card processing system that is typically designed for large volume batch processing of plastic cards, often employing multiple processing stations or modules to process multiple plastic cards at the same time to reduce the overall per card processing time. Examples of central issuance card processing systems include the MX family of central issuance systems available from Entrust Datacard Corporation of Shakopee, Minn. Other examples of central issuance systems are disclosed in U.S. Pat. Nos. 4,825,054, 5,266,781, 6,783,067, and 6,902,107, all of which are incorporated herein by reference in their entirety.

Another example of a type of plastic card printing system that can be used is referred to as a desktop card processing system that is typically designed for relatively small scale, individual plastic card processing. In desktop processing systems, a single plastic card to be processed is input into the system, processed, and then output. These systems are often termed desktop machines or desktop printers because they have a relatively small footprint intended to permit the machine to reside on a desktop. Many examples of desktop machines are known, such as the SD or CD family of desktop card machines available from Entrust Datacard Corporation of Shakopee, Minn. Other examples of desktop card machines are disclosed in U.S. Pat. Nos. 7,434,728 and 7,398,972, each of which is incorporated herein by reference in its entirety.

Figure 2:
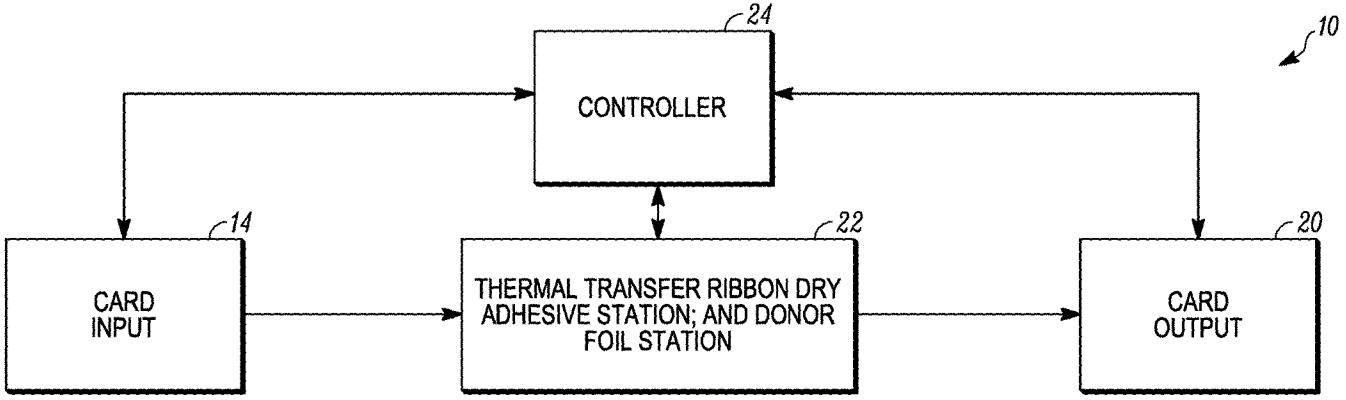
FIG. 2 is a schematic illustration of another embodiment of a plastic card printing system described herein.

FIG. 1 illustrates an example of one embodiment of a plastic card printing system 10 that can be used to print on and optionally additionally process plastic cards 12 (see FIGS. 5 and 6) as described herein. In this example, the system 10 can include a card input 14, a thermal transfer ribbon dry adhesive station 16, a donor foil station 18, and a card output 20. As discussed above, the elements 14-20 in the system 10 can be part of a central issuance card processing system or part of a desktop card processing system. The elements 14-20 can be separate stations or modules, or the functionalities of one or more of the elements 14-20 can be combined into what may be considered a common station or module with the other elements. For example, FIG. 2 shows the thermal transfer ribbon dry adhesive station 16 and the donor foil station 18 of FIG. 1 combined into a common station 22. A controller 24 is connected to and controls each of the elements 14-20 (or the elements 14, 20, 22 in FIG. 2).

The card input 14 can be a card input hopper designed to hold a plurality of cards waiting to be fed on-by-one into the system 10 for processing. An example of a card input hopper is described in U.S. Pat. No. 6,902,107 which is incorporated herein by reference in its entirety. Alternatively, the card input 14 can be an input slot through which individual cards are fed one-by-one into the system 10.

The thermal transfer ribbon dry adhesive station 16 can be located anywhere in the system 10 between the card input 14 and the card output 20 and is configured to apply an adhesive to a surface of the card 12 (see FIGS. 5 and 6) from a thermal transfer ribbon using techniques that are similar to thermal transfer printing techniques with a thermal printhead. Thermal transfer printing of ink using a thermal printhead is well known in the art.

Figure 5:
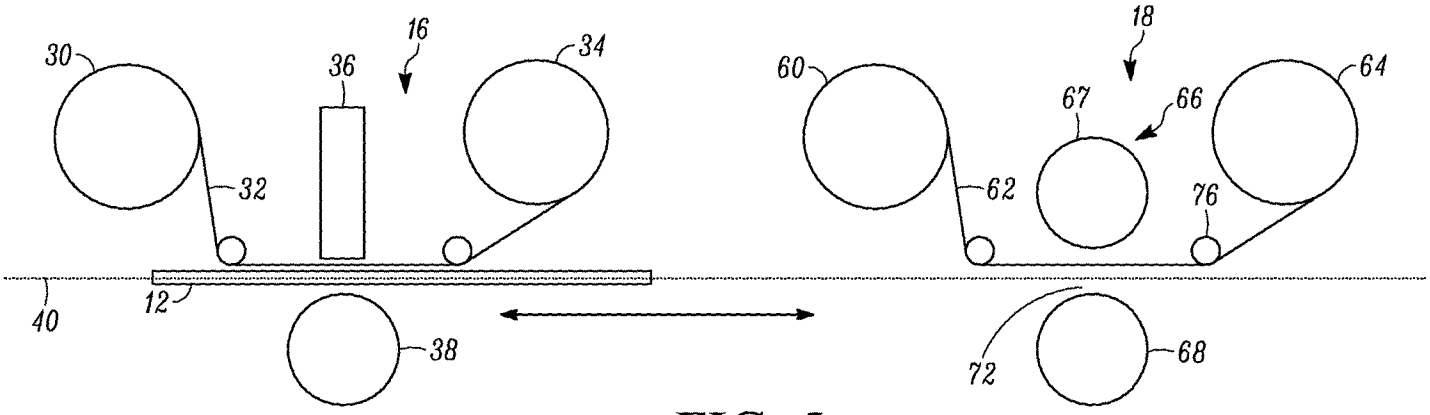
FIG. 5 is a schematic illustration of an embodiment of thermal transfer stations that can utilize the thermal transfer adhesive ribbon and the thermal transfer donor foil described herein.

FIG. 5 illustrates an example of the thermal transfer ribbon dry adhesive station 16. The station 16 includes an adhesive ribbon supply 30 that supplies a thermal transfer adhesive ribbon 32 having an adhesive layer thereon, and a ribbon take-up 34 that takes-up used portions of the thermal transfer adhesive ribbon 32 after portions of the adhesive layer are printed on the card surface. The adhesive ribbon 32 is transferred along a ribbon path between the ribbon supply 30 and the ribbon take-up 34 past a thermal printhead 36 that can be moved toward and away from an opposing fixed platen 38 to sandwich the adhesive ribbon 32 and the card 12 therebetween during printing of the adhesive onto the card surface. Alternatively, the platen 38 can be movable toward and away from the printhead 36 which can be stationary. The card 12 can be transported in both forward and reverse directions along a transport path 40 through the station 16 using conventional card transport mechanisms such as transport rollers.

As with conventional thermal transfer printing of ink, the thermal printhead 36 includes an array of resistive elements each of which can be selectively heated by controlling the flow of electricity to the individual resistive elements. At locations where the resistive elements are heated, adhesive from the adhesive ribbon 32 is transferred onto the card surface. Data for controlling the operation of the resistive elements can be input into the controller 24 (FIG. 1) which in turn controls the resistive elements of the thermal printhead 36. The adhesive can therefore be printed onto the card surface in patterns dictated by the data entered into the controller 24.

Figure 3:
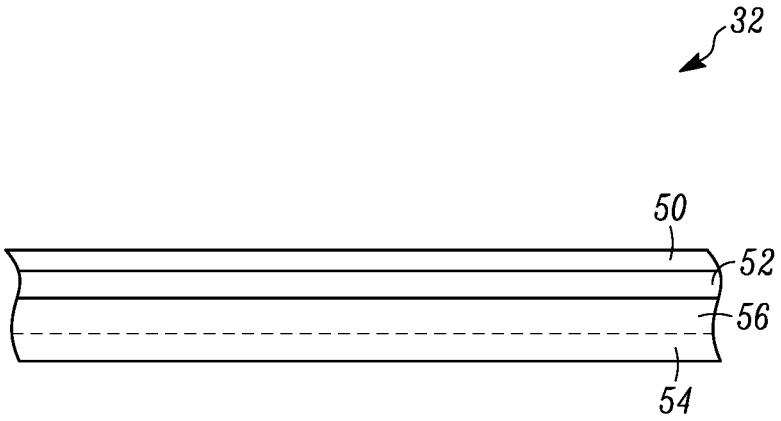
FIG. 3 is a cross-sectional view of a portion of an example thermal transfer adhesive ribbon described herein.

FIG. 3 illustrates an example construction of the adhesive ribbon 32. However, other constructions are possible. In this example, the adhesive ribbon 32 includes a back coat 50, a base film 52 on which the back coat 50 is disposed, an adhesive layer 54 and a release layer 56 between the base film 52 and the adhesive layer 54. The adhesive layer 54 and the release layer 56 can be separate layers from one another, or as implied by the dashed line in FIG. 3, the adhesive layer 54 and the release layer 56 could be combined into a single layer.

The adhesive layer 54 can be any type of adhesive that can be transferred onto the card surface by heat and/pressure using the thermal printhead 36. The adhesive of the adhesive layer 54, both while on the adhesive ribbon 32 and after being transferred onto the card surface, can be referred to as a dry adhesive. A dry adhesive is an adhesive that does not readily flow under normal operating conditions so that once applied to the card surface, the adhesive remains at its applied location for a period of time sufficient to allow subsequent application of a donor material onto the applied adhesive. Examples of adhesive that can be used for the adhesive layer 54 include, but are not limited to, polyester, polyurethane or polyacrylate adhesives. In some embodiments, the adhesive of the adhesive layer 54 can be a dry, ultraviolet (UV)-radiation curable adhesive that is cured by ultraviolet radiation after being applied to the card surface.

The back coat 50 is a coating on the base film 52 that prevents the printhead 36 from sticking to the base film 52 during application of the adhesive to the surface of the card.

The base film 52 is a layer that supports the layers 54, 56. The base film 52 can be, for example, polyethylene terephthalate (PET).

The release layer 56 resides between the base film 52 and the adhesive layer 54 to permit release of the adhesive layer 54 from the base film 52 when the ribbon 32 is stripped from the card surface. Release layers are well known in the art.

Returning to FIG. 1, the donor foil station 18 can be located anywhere in the system 10, for example downstream of the station 16 and between the station 16 and the card output 20. The station 18 is configured to bring together the card surface having the now transferred adhesive thereon and a donor foil having a transferrable layer that faces the surface of the card 12 and thereafter strip the donor foil from the surface of the card 12. When the donor foil is stripped, portions of the transferrable layer that are in contact with the transferred adhesive remain adhered to the card by the transferred adhesive and portions of the transferrable layer not in contact with the transferred adhesive remain on and are stripped with the donor foil.

FIG. 5 illustrates an example of the station 18. The station 18 includes a donor foil supply 60 that supplies a donor foil 62 having the transferrable layer thereon, and a donor foil take-up 64 that takes-up used portions of the donor foil after portions of the transferrable layer are transferred to the card surface. The donor foil 62 is transferred along a ribbon path between the donor foil supply 60 and the donor foil take-up 64 past a transfer mechanism 66. The transfer mechanism 66 can be any mechanism that brings the donor foil 62 into contact with the surface of the card 12. In one embodiment, the transfer mechanism 66 defines a nip 72 between which the donor foil 62 and the card 12 are directed in order to bring the donor foil 62 into contact with the surface of the card 12.

In the example illustrated in FIG. 5, the transfer mechanism 66 includes a heated roller 67 and an opposing fixed platen 68, such as a backing roller, that define the nip 72 therebetween. In one embodiment, the heated roller 67 is movably mounted so that the heated roller 67 can be moved toward and away from the fixed platen 68 to sandwich the donor foil 62 and the card 12 in the nip 72 therebetween when the donor foil 62 and the card surface are brought together. Alternatively, the platen 68 can be movably mounted so that the platen 68 can be moved toward and away from the heated roller 67 which can be stationary. The card 12 can be transported in both forward and reverse directions along the transport path 40 through the station 18 using conventional card transport mechanisms such as transport rollers.

Figure 6:
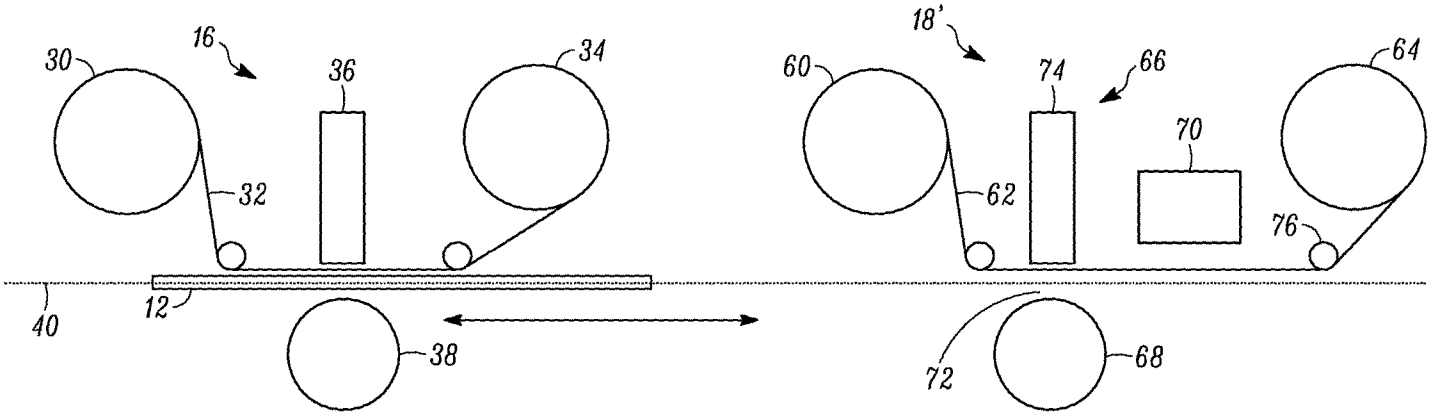
FIG. 6 is a schematic illustration of another embodiment of thermal transfer stations that can utilize the thermal transfer adhesive ribbon and the thermal transfer donor foil described herein.

FIG. 6 illustrates an embodiment of the transfer mechanism 66 that has a function similar to the transfer mechanism 66 in FIG. 5 in that the transfer mechanism 66 brings the donor foil 62 into contact with the surface of the card 12. However, in this embodiment, the transfer mechanism 66 includes a thermal printhead 74 instead of the heated roller 67. Like a conventional thermal printhead used in conventional thermal transfer printing of ink, the thermal printhead 74 includes an array of resistive elements each of which can be selectively heated by controlling the flow of electricity to the individual resistive elements. At locations where the resistive elements are heated, portions of the transferrable layer from the donor foil 62 are heated and subsequently transferred onto the card surface when the donor foil 62 is stripped. Data for controlling the operation of the resistive elements can be input into the controller 24 (FIG. 1) which in turn controls the resistive elements of the thermal printhead 74. In one embodiment, the data used to print the adhesive onto the card surface corresponds to the data used to control the printhead 74 so that the donor foil 62 and the transferrable layer are heated by the printhead 74 in a pattern that matches the printed pattern of the adhesive on the card surface.

When the donor foil 62 is subsequently stripped from the card surface at stripping pin 76, the portions of the transferrable layer that are in contact with and adhered to the adhesive remain adhered to the transferred adhesive on the card surface and portions of the transferrable layer not in contact with and adhered to the adhesive remain on and are stripped with the donor foil 62.

In one embodiment, heat and/or pressure applied by the transfer mechanism 66 can be sufficient to transfer and adhere the transferrable layer to the transferred adhesive on the card surface when the donor foil 62 is stripped. Therefore, in this embodiment, the transferred adhesive does not require curing before or after the transferrable layer is transferred.

In another embodiment, the adhesive used is such that the adhesive requires curing after the transferrable layer is transferred. For example, if the adhesive is a dry, UV-radiation curable adhesive, UV radiation is applied to the adhesive to cure the adhesive. For example, referring to FIG. 6, a curing station 70 can be provided that applies UV radiation to cure the UV-radiation curable adhesive after the donor foil 62 and the card surface are brought together. In the illustrated example, the curing station 70 is located downstream of the transfer mechanism 66, for example between the transfer mechanism 66 and the stripping pin 76 where stripping of the donor foil 62 takes place. The curing station 70 can also be used in the embodiment illustrated in FIG. 5.

Figure 4:
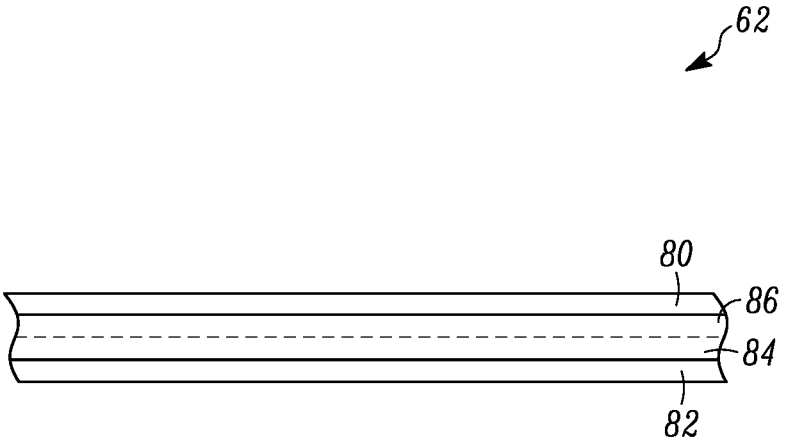
FIG. 4 is a cross-sectional view of a portion of an example thermal transfer donor foil described herein.

FIG. 4 illustrates an example construction of the donor foil 62. However, other constructions are possible. In this example, the donor foil 62 includes a base layer 80, a donor material layer 82, an abrasion resistant coating layer 84, and a release layer 86 between the base layer 80 and the abrasion resistant coating layer 84. The abrasion resistant coating layer 84 and the release layer 86 can be separate layers from one another, or as implied by the dashed line in FIG. 4, the abrasion resistant coating layer 84 and the release layer 86 could be combined into a single layer. Use of the abrasion resistant coating layer 84 is also optional if a protective coating layer is later applied over the card surface.

In the illustrated example, both the donor material layer 82 and the abrasion resistant coating layer 84 (if present) transfer to the card surface thereby forming the transferrable layer described herein. Once transferred, the abrasion resistant coating layer 84 (if present) forms an outermost layer overlaying the donor material layer 82 and the adhesive 54, thereby protecting the underlying donor material layer 82 from degradation and wear. However, the transferrable layer can be formed solely by the donor material layer 82.

The donor material layer 82 can be a material that forms what may be referred to as a high value visual feature on the card surface. The donor material of the donor material layer 82 can provide an optical structure such as a hologram or a diffractive pattern, a three dimensional feature, a matte finish, a metallic or metallic looking appearance, and the like. In one embodiment, the donor material layer 82 can have a thickness of between about 1 to 3 microns.

The abrasion resistant coating layer 84 (if present) can be any material that provides abrasion resistance to the underlying donor material after being transferred to the card surface. The abrasion resistant coating of the layer 84 can be transparent to minimize visual impact on the underlying donor material, or translucent where the abrasion resistant coating at least partially has a visual impact on the underlying donor material.

The base layer 80 is a layer that supports and protects the layers 82, 84, 86 prior to use, and when the donor foil 62 is rolled into a roll used for the donor foil supply 60, prevents the donor material layer 82 from adhering to the donor foil 62 allowing the donor foil 62 to be unwound. In one non-limiting embodiment, base layer 80 can be, for example, PET.

The release layer 86 resides between the base layer 80 and the abrasion resistant coating layer 84 to permit release of the abrasion resistant coating layer 84 and the donor material layer 82 from the base layer 80 when the donor foil 62 is stripped from the card surface. Release layers are well known in the art.

In operation and referring to FIGS. 3-6, adhesive from the adhesive layer 54 is transferred to a surface of the plastic card 12 from the ribbon 32 using the thermal printhead 36 in the station 16. Thereafter, the donor foil 62 and the surface of the card 12 bearing the transferred adhesive are brought together in the station 18 using the transfer mechanism 66. Thereafter, the donor foil 62 is stripped from the surface of the plastic card 12. Portions of the transferrable layer (i.e. the donor material layer 82 and optionally the abrasion resistant coating layer 84) that are in contact with the transferred adhesive remain adhered to the transferred adhesive and portions of the transferrable layer not in contact with the transferred adhesive remain on the donor foil 62 which is wound up on the donor foil take-up 64.

The card output 20 can be a card output hopper designed to hold a plurality of processed cards that are output one-by-one after being processed within the system 10. An example of a card output hopper is described in U.S. Pat. No. 6,902,107 which is incorporated herein by reference in its entirety. Alternatively, the card output 20 can be an output slot through which individual cards are output one-by-one. In the case of central issuance card processing systems, the card output 20 can be the last element in the system 10 and located at the downstream end of the system 10. In the case of desktop card processing systems, the card output 20 can be located at the downstream end of the system 10 in some systems, or even located at the same end of the system 10 as the card input 14.

Returning to FIGS. 1 and 2, the systems 10 described herein can include additional stations in addition to the stations 14, 16, 18, 20, 22. For example, the systems 10 can include one or more of a magnetic stripe station that programs a magnetic stripe on the card 12, an integrated circuit chip station that can program a programmable chip on the card 12 or simultaneously program multiple cards, a thermal transfer print station that performs thermal dye or ink printing, a drop-on-demand printer that can perform drop-on-demand ink printing, a card flipper (or card reorienting mechanism) that can rotate a card 180 degrees so that a surface facing upward (or facing to one side) now faces downward (or faces toward the opposite side), an embossing station that embosses characters on the card, an indenting station that indents characters on the card, a card verification station that verifies data applied to the card, and other card processing stations that are well known in the art of plastic card processing. The additional stations can be located anywhere in the systems 10 with some of the stations, such as a magnetic stripe station and an integrated circuit chip station, being located between the card input 14 and the station 16, and some of the stations being located between the station 18 and the card output 20.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A plastic card printing method, comprising:

transferring an adhesive to a surface of the plastic card from a first thermal transfer ribbon bearing the adhesive using a first thermal printhead;

thereafter bringing together the surface of the plastic card bearing the transferred adhesive and a donor foil, the donor foil including a transferrable layer that faces the surface of the plastic card; and thereafter stripping the donor foil from the surface of the plastic card whereby portions of the transferrable layer in contact with the transferred adhesive remain adhered to the transferred adhesive and portions of the transferrable layer not in contact with the transferred adhesive remain on the donor foil.

2. The plastic card printing method of claim 1, comprising bringing together the surface of the plastic card bearing the transferred adhesive and the donor foil using a heated roller.

3. The plastic card printing method of claim 2, further comprising applying ink or dye to the surface of the plastic card using a second thermal printhead.

4. The plastic card printing method of claim 1, comprising bringing together the surface of the plastic card bearing the transferred adhesive and the donor foil using a second thermal printhead, and further comprising heating the second thermal printhead at locations corresponding to locations of the transferred adhesive as the plastic card and the donor foil are transported past the second thermal printhead.

5. The plastic card printing method of claim 1, wherein the transferred adhesive is a dry adhesive.

6. The plastic card printing method of claim 1, wherein the transferred adhesive is a dry ultraviolet-radiation curable adhesive, and further comprising curing the transferred dry ultraviolet-radiation curable adhesive using ultraviolet radiation.

7. A plastic card printing method, comprising:

inputting a plastic card into a thermal transfer adhesive station having a first thermal printhead and a first thermal transfer ribbon bearing a thermally transferrable adhesive;

using the first thermal printhead to transfer a portion of the thermally transferrable adhesive onto a surface of the plastic card from the first thermal transfer ribbon; and thereafter applying a transferrable layer onto the transferred adhesive on the surface of the plastic card.

8. The plastic card printing method of claim 7, wherein the plastic card comprises at least one of a magnetic stripe or an integrated circuit chip.

9. The plastic card printing method of claim 7, wherein applying the transferrable layer onto the transferred adhesive on the surface of the plastic card comprises bringing together the surface of the plastic card and a donor foil bearing the transferrable layer so that the transferrable layer on the donor foil is in contact with the transferred adhesive, and thereafter stripping the donor foil from the surface of the plastic card whereby portions of the transferrable layer on the donor foil in contact with the transferred adhesive remain adhered to the transferred adhesive and portions of the transferrable layer on the donor foil not in contact with the transferred adhesive remain on the donor foil.

10. The plastic card printing method of claim 9, comprising bringing together the surface of the plastic card bearing the transferred adhesive and the donor foil using a heated roller.

11. The plastic card printing method of claim 9, comprising bringing together the surface of the plastic card bearing the transferred adhesive and the donor foil using a second thermal printhead, and further comprising heating the second thermal printhead at locations corresponding to locations of the transferred adhesive as the plastic card and the donor foil are transported past the second thermal printhead.

12. The plastic card printing method of claim 7, wherein the transferred adhesive is a dry adhesive.

13. The plastic card printing method of claim 7, wherein the transferred adhesive is a dry ultraviolet-radiation curable adhesive, and further comprising curing the transferred dry ultraviolet-radiation curable adhesive using ultraviolet radiation.

* * * * *